United States Patent [19]

Mojden

[11] Patent Number: 4,620,701

[45] Date of Patent: Nov. 4, 1986

[54] ADJUSTABLE EXERCISE APPARATUS

[76] Inventor: Daniel R. Mojden, 5519 S. Garfield, Hinsdale, Ill. 60521

[21] Appl. No.: 642,528

[22] Filed: Aug. 20, 1984

[51] Int. Cl.[4] ..... A63B 23/00; A63B 1/00

[52] U.S. Cl. ..... 272/63; 272/144

[58] Field of Search ..... 272/63, 144, DIG. 4, 272/62, 109, 93, 112, 113; 128/25 R; 211/123, 182, 175, 208; 248/122, 125, 286, 287, 296, 242

[56] References Cited

U.S. PATENT DOCUMENTS

| | | | |
|---|---|---|---|
| 277,399 | 5/1883 | Worthington . | |
| 1,111,268 | 9/1914 | Medart . | |
| 1,915,371 | 6/1933 | Lowman | 272/144 |
| 2,690,789 | 10/1954 | Zadrozny | 155/22 |
| 3,112,928 | 12/1963 | Oswald | 272/144 X |
| 3,567,219 | 3/1971 | Foster | 272/63 X |
| 3,612,042 | 10/1971 | Fry | 272/93 X |
| 3,709,487 | 1/1973 | Walker | 272/63 |
| 3,713,653 | 1/1973 | Romans | 272/67 |
| 4,332,381 | 6/1982 | Lyons | 272/63 X |
| 4,492,375 | 1/1985 | Connelly | 272/144 X |

FOREIGN PATENT DOCUMENTS

| | | | |
|---|---|---|---|
| 420111 | 10/1925 | Fed. Rep. of Germany . | |
| 1257091 | 2/1961 | France | 128/25 R |
| 1507361 | 11/1967 | France | 272/144 |
| 2065482 | 7/1981 | United Kingdom | 272/144 |

OTHER PUBLICATIONS

Marcy's 2-Way Master Gym, Marcy Gym Equipment Company Catalog, ©1971, p. 14.

Marcy's All-in-One Gym, Marcy Gym Equipment Company Catalog, Oct. 1969, p. 28.

*Primary Examiner*—Richard J. Johnson

*Attorney, Agent, or Firm*—Trexler, Bushnell & Wolters, Ltd.

[57] ABSTRACT

An adjustable exercise apparatus is disclosed. The apparatus includes a pair of elongated handle members capable of being grasped by an exercising individual. The handles extend, in cantilevered fashion, from a support bar which is disposed substantially horizontally. The horizontal bar is connected to a vertical pillar by a vertical angle adjusting arrangement and the pillar is mounted upon a stationary base. The vertical angle adjusting arrangement permits the horizontal bar and connected handles to be adjusted into any one of a plurality of mutually parallel positions angularly spaced apart from one another in respective vertical planes. When the handles are adjusted into angular positions out of the horizontal, the difficulty of exercise is increased, and increased exercise benefits are obtained. In another embodiment, a set of overhead pull handles are also provided.

17 Claims, 9 Drawing Figures

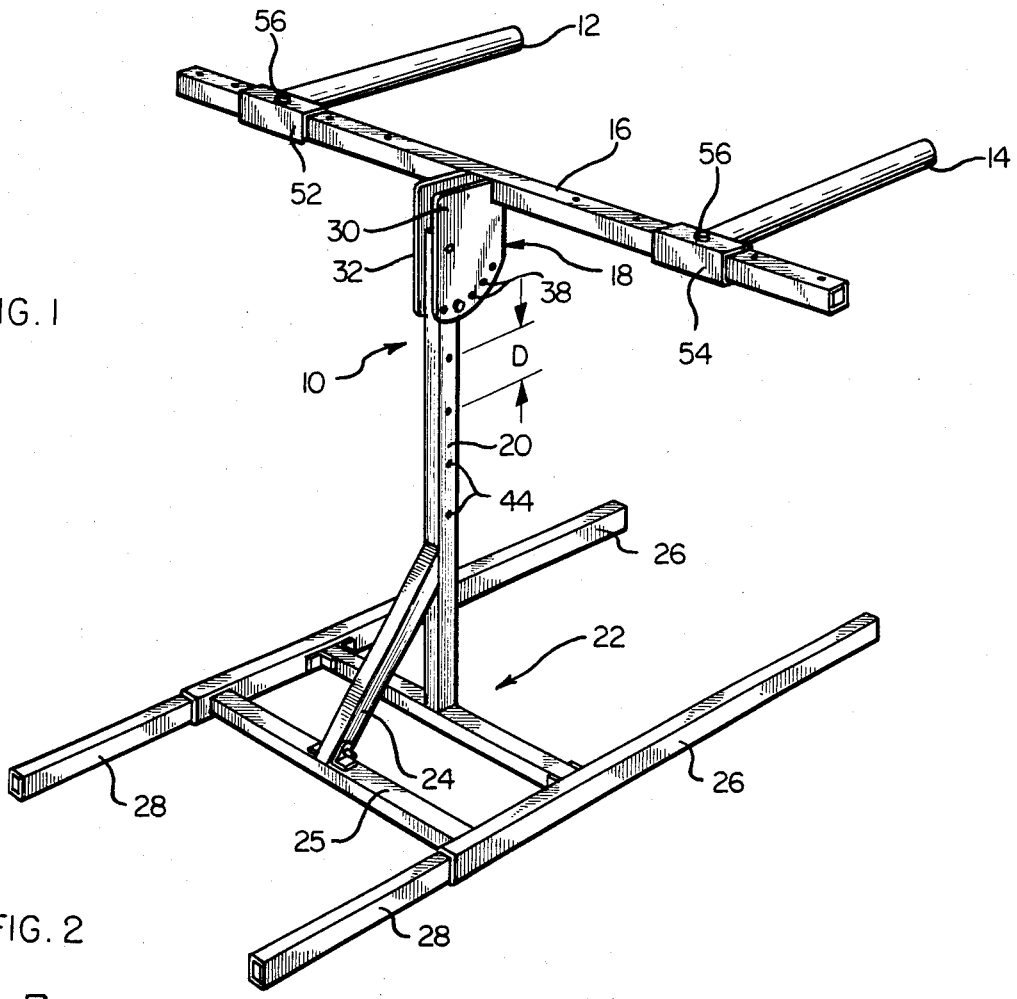
FIG. 1
FIG. 2
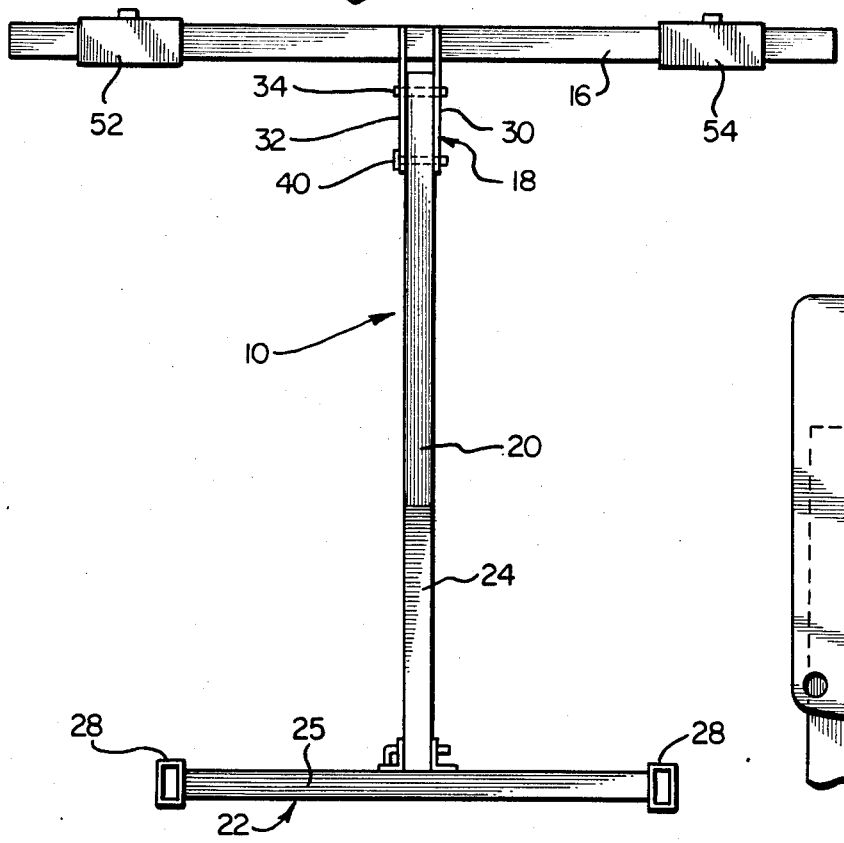
FIG. 3
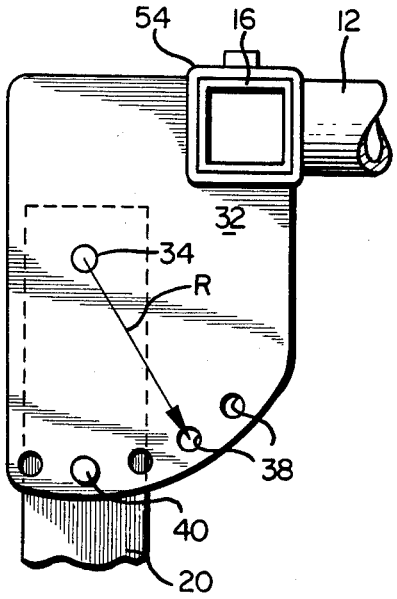

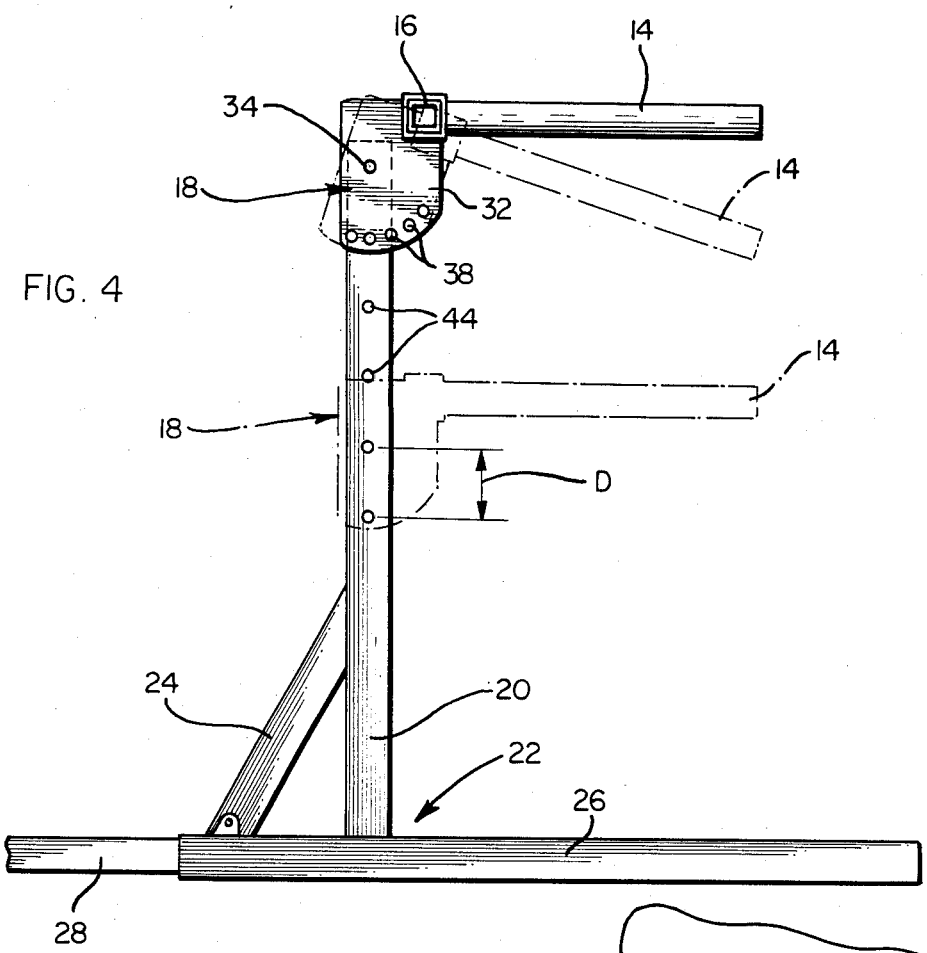
FIG. 4
FIG. 5
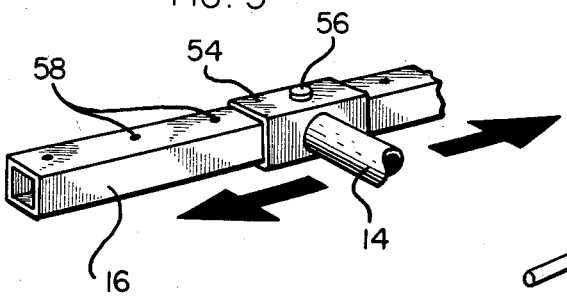
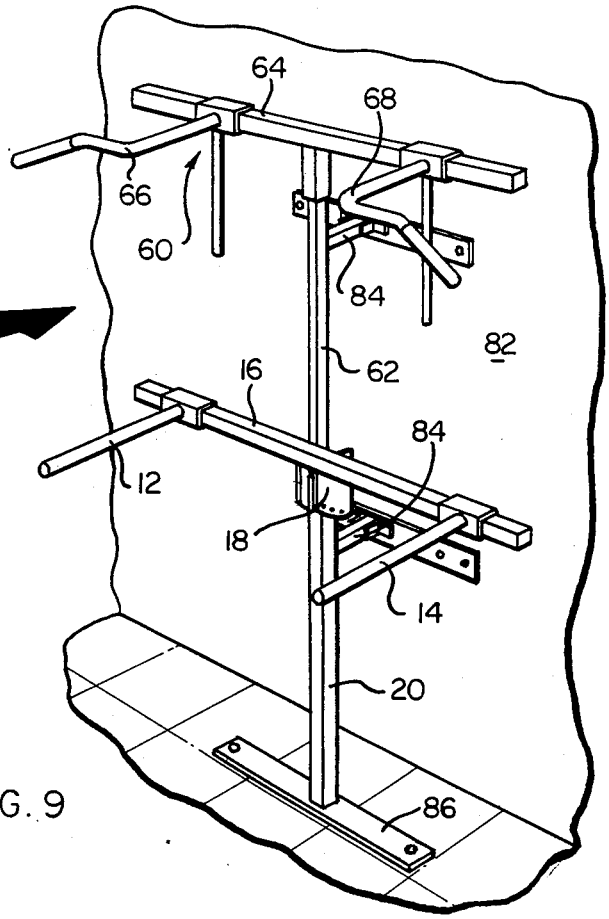
FIG. 9

ADJUSTABLE EXERCISE APPARATUS

BACKGROUND OF THE INVENTION

This invention relates generally to exercise apparatus, and more particularly to an adjustable apparatus often referred to as a dip bar.

Exercising, and the use of exercising apparatus, is becomming increasingly popular. The regular and proper use of such apparatus provides the exercising individual with a heightened feeling of well-being and improved muscle tone, strength, and general fitness. One highly effective exercise device is the dip bar, which includes a pair of spaced parallel rails or bars disposed for grasping by the exercising individual. By appropriately flexing the arms and arm muscles, the exercising individual can raise himself or herself off the floor, or do pushup-like exercises, or engage in other exercising activity.

While exercising on conventional dip bars is good exercise, it is believed that muscle strength and muscle tone can be improved even further by re-orienting the exercising bars or handles at various angular positions. The re-orientation of these handles causes the exercising individual to exercise different sets of muscles, or to use muscles in ways which are at least slightly altered from the normal exercise regime with conventional dip bars. Such variations in exercise produces increased muscle tone and fitness.

More specifically, the basic "dip" is a two stage exercise starting with the arms fully extended with the hands holding onto the handles or bars to keep the body suspended off the ground in a perpendicular position. The first stage of the exercise is to lower the body down until the upper arms and forearms form a substantially right angle. The second stage is to push the body back up to the starting position wherein the arms are fully extended.

When performing "dips", the primary exercise benefit is gained from the second stage of the exercise. This is because most exercising individuals simply let gravity and their weight pull them down until they are in a position to begin the second, or push-up, part of the exercise.

With the novel apparatus disclosed here, the exercise handles can be re-oriented at an angle to the floor. The advantage of doing "dips" with the handles so positioned is that the exerciser has gravity and body weight working against him or her on both stages of the exercise. When beginning dips, a conscientious exerciser leans forward to make the exercise harder and work the muscles more extensively. But, as the muscles get tired, the body slips back into a vertically perpendicular plane. When doing "dips" with the apparatus of the present invention handles angled toward the floor, the body is forced to lean forward because of gravity. This inhibits the exerciser from slipping back into the old vertical position. Thus it is almost impossible for the exerciser to "cheat" on the exercise. This aids in the exercise, in at least two ways: first, the exerciser must balance his or her body. Secondly, by urging the upper body to lean forward, the shoulder muscles must work harder.

A number of major muscle groups are exercised when "doing dips". The use of each group changes as the angle of the handles change. The exercised muscles, and the changes in muscle use, include:

(1) Outside the lower area of the pectoral muscle. No extensive change.

(2) Tricep Area. As the handles are moved to more nearly vertical orientations, these muscles are increasingly used.

(3) Posterior Deltoids. No extensive change.

(4) Forearm. As the handles are inclined toward the vertical, use of these muscles increases to provide body balance.

(5) Anterior Deltoids. As the handles are inclined toward the vertical, use of these muscles increases to provide body balance.

(6) Clavicular Portion. As the handles are inclined toward the vertical, use of these muscles increases greatly.

(7) Sternal Portion of the Chest. As the handles are inclined toward the vertical, use of these muscles increases greatly.

(8) Lattissimus Dorsi. These muscles are stretched more as the handles are inclined toward the vertical.

(9) Terres Major. As the handles are inclined toward the vertical, use of these muscles increases.

Thus, proper use of the apparatus disclosed here will provide good exercise. As the apparatus is adjusted, the exercise becomes more difficult, and the benefits of the exercise increase.

BRIEF DESCRIPTION OF THE DRAWINGS

FIG. 1 is a perspective view of a first embodiment of the apparatus;

FIG. 2 is an end elevational view of the apparatus shown in FIG. 1;

FIG. 3 is a fragmentary side elevational view of mechanism by which the vertical angle of the apparatus handles can be adjusted;

FIG. 4 is a side elevational view of the apparatus of FIG. 1 and showing, in phantom lines, the exercise handles located at various elevational and angular positions;

FIG. 5 is a fragmentary perspective view showing in detail a portion of the horizontal bar and the attached exercise handle;

FIG. 9 is a perspective view of the alternate embodiment of FIG. 6 mounted to wall or stationary vertical support surface.

DETAILED DESCRIPTION

Figure 6:
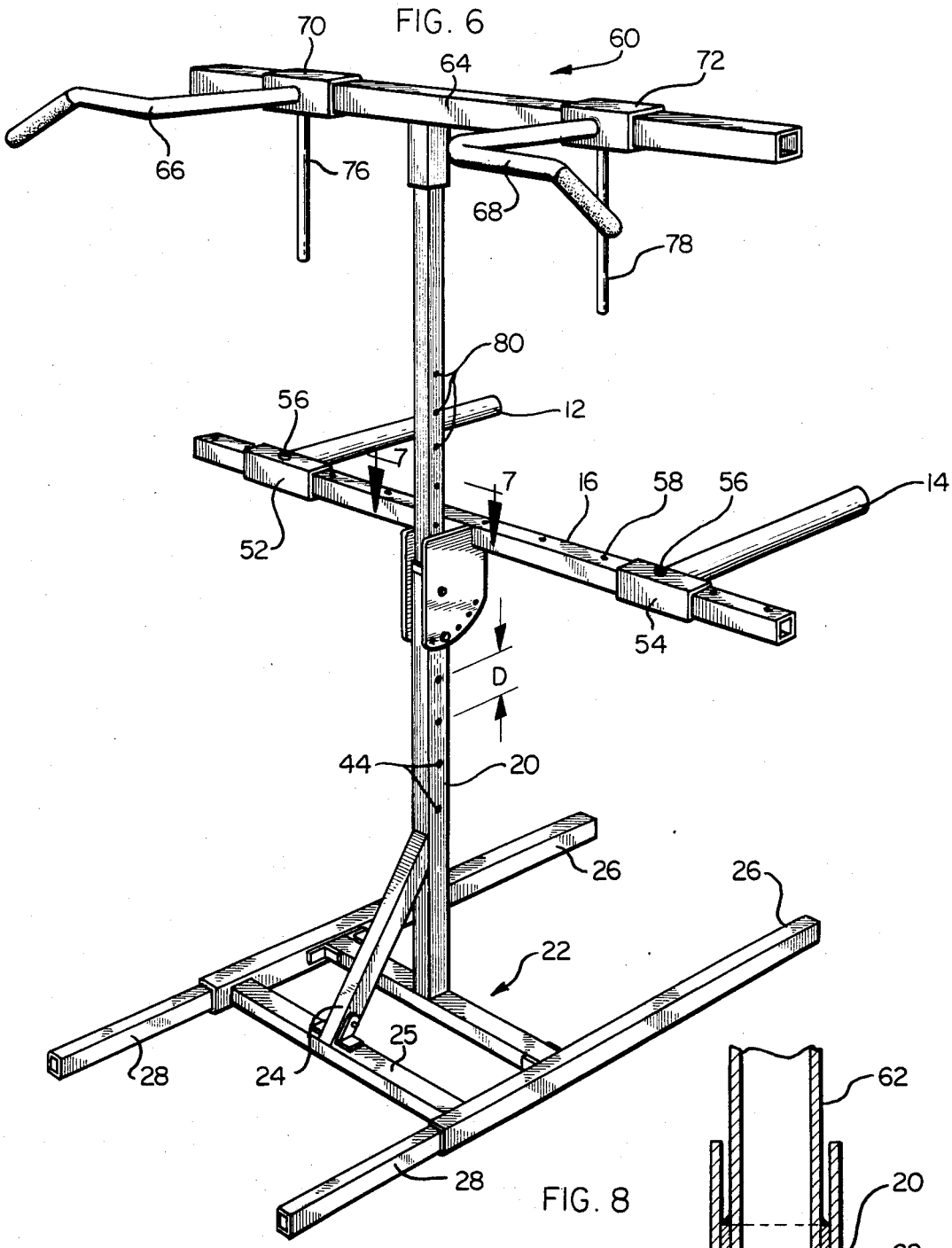
FIG. 6 is a perspective view similar to FIG. 1 but showing an alternate embodiment of the apparatus including a set of pull handles.

While the invention will be described in connection with several preferred embodiments, it will be understood that it is not intended to limit the invention to these embodiments. On the contrary, it is intended to cover all alternatives, modifications and equivalents as may be included within the spirit and scope of the invention as defined by the appended claims.

Turning first to FIG. 1, there is shown a first embodiment of the exercise apparatus 10. In general, this apparatus can be considered to include a pair of elongated handle members 12 and 14, which are oriented substantially parallel to one another and which each extend outwardly from a horizontally supported bar 16 in a cantilevered arrangement. The horizontally disposed bar 16 is affixed to a vertical angle adjustment mechanism or bracket 18; and the vertical angle adjustment mechanism 18 is mounted, in turn, upon a centrally located, vertically oriented pillar member 20. The mediate support pillar 20 is connected, in turn, to a base assembly 22.

To ensure that the pillar 20 is rigidly attached to this base 22, an interconnector diagonal support structure 24 is connected, as by suitable pin or weldment arrangements, between a base cross member 25 and the pillar 20. Stability and good support are provided by base rail members 26 mounted perpendicularly to the cross member 25 and to a center strut 27. Additional stability can be obtained by providing each rail 26 with a telescoping extension 28. The bar 16, pillar 20, and base 22 can be formed of any suitable material such as, for example, four and one-half inch square columnar steel lengths.

In accordance with the invention, the handles 12, 14 can be adjusted into any one of a plurality of mutually parallel positions angularly spaced apart from one another in a vertical plane. When the handles 12, 14 are adjusted into positions such as those shown in phantom lines at the top of FIG. 4, exercise difficulty is increased, and increased exercise benefits are the result. To this end, the angular adjustment mechanism or bracket 18 here includes two opposed plates 30, 32 which are welded to the bar 16. The bracket 18 in turn is mounted to pillar 20 by pins 34 and 40 which extend through apertures 44 in said pillar 20. A series of angularly spaced holes 38 are provided in each plate 30 and 32, and the holes in each plate 30, 32 are in registry with the holes in the other plate. These holes 38 are arrayed on the circumference of a circle whose center C is located at the location of the upper pin 34. By aligning one set of these holes 38 with an aperture array 44 extending through the pillar 20, and by inserting a lower pin 40, the cantilevered handles 12, 14 can be arranged in any one of a variety of angularly distinct positions, as suggested particularly in FIG. 4.

To permit the vertical height or location of the bar 16 and handles 12, 14 to be adjusted in accordance with another aspect of the invention, the pillar 20 is provided with a series of regularly spaced apart height adjusting apertures 44. These apertures 44 are spaced apart from one another at a distance D which is equal to the radius R of the inter-hole spacing provided in the vertical angle adjustment plates 30, 32, as suggested in FIGS. 1, 3, 4 and 6. In this way, the vertical height of the handles 12, 14 can be selected and the vertical angle mounting bracket 18 can be mounted at the desired height through one of the apertures 44 formed in the pillar 20. The desired vertical angle for the handles 12, 14 can then be selected by simply aligning one set of the vertical angle alignment holes 38 in the plates 30, 32 with the appropriate and immediately adjacent apertures 44 in the pillar 20. The pin 40 can then be slipped through the plate 30, the column 20, and the opposite plate 32 so as to lock the bar 16 and handles 12, 14 into the desired position, as suggested in FIG. 4.

Positioning of the bar 16 and handles 12 and 14 in the orientation as shown in phantom in FIG. 4 permit the apparatus to be employed in a number of exercises that can not be done on conventional dip bars. For example, an individual can lay on his back between the rails 26 of the base, grip the handles 12 and 14 and do "pull-ups". Alternately the bar 16 may be oriented at its lower most position and an "angled push-up" exercise performed by gripping the handles and lowering oneself between the spaced handle members 12 and 14.

In accordance with yet another aspect of the invention, the location of each handle member 12, 14 can be adjusted in a horizontal direction along the bar 16 so as to change the spacing between these handle members. This adjustment or change in spacing permits persons of different sizes and physiques to use the exercise apparatus with ease and facility, and accommodates exercises of various regimes or sorts.

To this end, each handle 12, 14 terminates at a tubular structural fitting 52, 54 which is slidably carried on the handle 16. To secure the handles 12, 14 in the desired location on the bar 16 and prohibit handle movement during exercising activity, pins 56 can be inserted through the box structures 52, 54 and mating holes 58 formed in the bar 16 itself.

Figure 7:
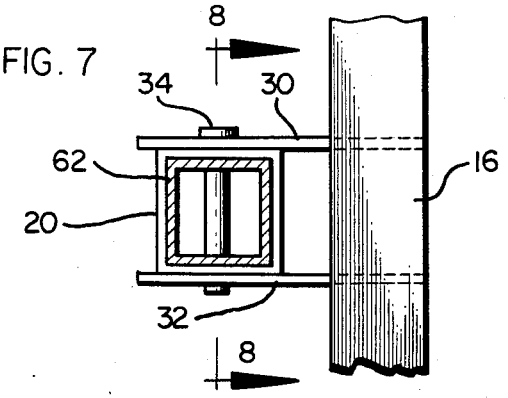
FIG. 7 is a fragmentary sectional view taken substantially in the plane of line 7—7 in FIG. 6.
Figure 8:
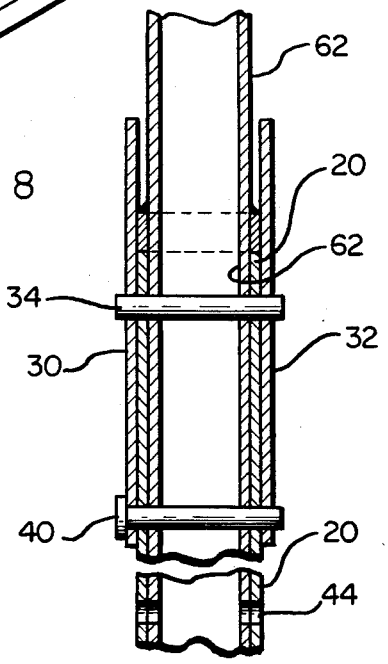
FIG. 8 is a fragmentary sectional view taken substantially in the plane of line 8—8 in FIG. 7.

Additional exercise activities can be performed with the embodiment of the invention as shown in FIGS. 6–8. Here, an overhead pull-up apparatus 60 is provided. This pull-up apparatus 60 includes a pillar extension member 62 extending upwardly from the main pillar 20. Atop the pillar extension 62 is mounted a second or additional horizontal bar 64. Handles 66, 68 are slidably carried on the bar 64 by providing each handle 66, 68 with a tubular structural arrangement 70, 72 slidably mounted to the horizontal bar 64. Auxiliary handles 76, 78 can be attached to each of the members 70, 72 to facilitate relocation of the respective handles 66, 68 by the exercising individual.

As shown in FIGS. 7 and 8, the pillar extension 62 can also be formed of a box-like structural steel member of any convenient size. For example, the pillar member 20 can be formed of four and one-half inch box channel iron, and the pillar extension 62 can be conveniently formed to slide into and out of the main pillar 20 with a telescoping fit. This pillar extension 62 can take the form of four and one-quarter inch box channel iron, for example. The vertical height of the overhead pull arrangement can be adjusted in a manner similar to that used to adjust the vertical height of the handles 14, 16. To this end, a series of holes 80 are formed in the pillar extension 62, and are located so as to register with the holes 44 in the pillar 20. Thus the height of the bar 64 above the floor can be adjusted within the limits provided by the holes 80.

With the embodiment of FIG. 6, two individuals can exercise at the same time, one doing dips, or other exercises, on the handles 12 and 14, the other performing pull-ups on the elevated bars 66 and 68. With the embodiment of FIG. 6, the extensions 28 on the base 22 must be used for stability.

Directing attention now to FIG. 9, there is disclosed a further modification of the apparatus of the invention. The embodiments as discussed to this point all relied upon a horizontal base structure 22 which rested upon the floor or some other horizontal surface in order to support the vertical or mediate pillar 20, or the pillar extension 62, FIG. 6. With the embodiment of FIG. 9, the mediate pillar 20 and pillar extension 62 are in effect wall mounted, thereby obviating use of a base structure similar to base 22.

The basic exercise apparatus as shown in FIG. 9 is similar to that discussed with respect to FIG. 6. In this regard, there is employed a mediate pillar 20 which is mounted to the wall 82 by one or more brace members 84. Similarly, the pillar extension 62 is also mounted to wall 82 by a brace member 84. Affixed to the pillar 20 is an adjustment bracket 18 which carries support bar 16 and the handles 12 and 14. The pull-up apparatus 60 is mounted to the upper end of the pillar extension 62. In addition a floor support or brace 86 is used to further support the pillar 20. While the embodiment of FIG. 9 includes both the dip bar apparatus 12; 14; 16, and the pull-up apparatus 60, it should be noted that the pull-up apparatus may be omitted, as desired.

It should be noted that preferred embodiments of the invention have been illustrated and described. It is realized that various modifications of the described embodiments are possible without departing from the aspect and scope of the invention as defined by the claims appended hereto.

The invention is claimed as follows:

1. An adjustable dip bar exercise apparatus, comprising, in combination, a pair of elongate handle members capable of being grasped by an exercising individual, and a handle support structure for supporting the elongate handles, the handle support structure including, a base means, vertically extending mediate support structure connected to the base means, a horizontal support bar having the elongate handle members mounted thereon said handle member being located in substantially the same plane as the support bar, and vertical angle adjusting means operatively interconnecting the mediate support structure and the horizontal support bar, said vertical angle adjusting means including a bracket member pivotally connected to said vertically extending mediate support structure and having said horizontal support bar affixed thereto, said bracket means being selectively positionable in a fixed orientation for adjusting the position of the horizontal support bar and for positioning and supporting the handles mounted to said horizontal support bar in any one of a plurality of angular positions while maintaining the handles spaced apart from one another in respective vertical planes.

2. An adjustable exercise apparatus according to claim 1 wherein said mediate support structure includes a vertically extending pillar means connected to said vertical angle adjusting means.

3. An adjustable exercise apparatus according to claim 2 wherein said vertically extending pillar means is located substantially midway between said two handle members.

4. An adjustable exercise apparatus according to claim 2 wherein said handle support structure further includes interconnector means rigidly connecting said vertically extending pillar to said base means.

5. An adjustable exercise apparatus according to claim 2 further including height adjusting means for adjusting the vertical location of said pair of handles relative to said pillar means.

6. An adjustable exercise apparatus according to claim 1 further including pull attachment means located above said handle members at a position normally above the head of a standing, exercising individual.

7. An adjustable exercise apparatus according to claim 6 further including pillar extension means supportively connected to said pillar means and said pull means.

8. An adjustable dip bar exercise apparatus comprising, in combination, base means, vertically extending mediate support structure connected to the base means, bar means disposed substantially horizontally, at least two handle members, each handle member extending outwardly from the bar means in a cantilevered arrangement and oriented substantially parallel to the other handle member, and vertical angle adjusting means connected to the mediate support structure and to the bar means, said vertical angle adjusting means including a bracket member connected to said vertically extending mediate support structure and including means for fixedly retaining said bracket member in a selected angular position such that said bar means and handle members may be supported in any one of a plurality of angular positions spaced apart and generally parallel to one another in respective vertical planes.

9. An adjustable exercise apparatus according to claim 8 wherein said mediate support structure comprises a centrally located, vertically oriented pillar member for supporing the vertical angle adjusting means, the bar means, and the handle members.

10. An adjustable exercise apparatus according to claim 9 further including height adjusting means for adjusting the vertical location of said bar means relative to said pillar means.

11. An adjustable exercise apparatus according to claim 9 further including interconnector means rigidly connecting said vertically extending pillar to said base means.

12. An adjustable exercise apparatus according to claim 8 further including means for adjusting the location of each handle member along the bar means in a horizontal direction so as to adjust the spacing between said handle members.

13. An adjustable exercise apparatus according to claim 8 further including pull attachment means located above said handle members at a position normally above the head of a standing, exercising individual.

14. An adjustable exercise apparatus according to claim 13 further including pillar extension means supportively connected to said pillar means and to said pull means.

15. An adjustable exercise apparatus according to claim 14 wherein said pull means includes a pair of pull handles capable of being grasped by an exercising individual.

16. An adjustable exercise apparatus according to claim 8 wherein said base means includes a horizontally disposed frame which supports said mediate support structure.

17. An adjustable exercise apparatus according to claim 8 wherein said base means comprises one or more brace members adapted to mount said mediate support structure to a vertical surface.

* * * * *